United States Patent [19]

Plasko

[11] 3,952,274

[45] Apr. 20, 1976

[54] THERMALLY ACTUATABLE SWITCH CONSTRUCTION

[75] Inventor: Emil Robert Plasko, Washington Township, Ohio

[73] Assignee: Micro Devices Corporation, Dayton, Ohio

[22] Filed: Oct. 4, 1974

[21] Appl. No.: 512,353

[52] U.S. Cl. ..... 337/407; 337/408

[51] Int. Cl.[2] ..... H01H 37/76

[58] Field of Search ..... 337/407, 408, 409

[56] References Cited

UNITED STATES PATENTS

| | | | |
|---|---|---|---|
| 2,934,628 | 4/1960 | Massar et al. | 337/409 |
| 3,180,958 | 4/1965 | Merrill | 337/409 |
| 3,291,945 | 12/1966 | Merrill et al. | 337/407 X |
| 3,727,164 | 4/1973 | Cartier et al. | 337/409 |

*Primary Examiner*—George Harris

*Attorney, Agent, or Firm*—Biebel, French & Nauman

[57] ABSTRACT

A thermally actuatable switch having a housing provided with a pair of leads, one of the leads having a contact and the other of the leads having a spring blade for making contact with the contact to complete an electrical circuit between the leads. The spring blade has a normal bias to move the same out of contact with the contact to open the circuit. A temperature sensitive member is carried by the housing and is adapted to collapse when the same is at a predetermined temperature. A biasing member is operatively associated with the temperature sensitive member and the spring blade to resiliently hold the spring blade in contact with the contact as long as the temperature sensitive member is in an uncollapsed condition thereof whereby the biasing member substantially compensates for any shrinkage and/or deterioration of the temperature sensitive member during its uncollapsed life and thus maintains the spring blade in contact with the contact.

17 Claims, 12 Drawing Figures

THERMALLY ACTUATABLE SWITCH CONSTRUCTION

This invention relates to an improved thermally actuatable switch construction and method of making the same.

It is well known that thermally actuatable switch constructions have been provided wherein a bridging member is held in conductive relation between two leads of the switch construction by a temperature sensitive member as long as that temperature sensitive member does not reach a predetermined temperature. When such temperature sensitive member reaches the predetermined temperature, the same collapses and, through a certain spring arrangement, the bridging member is moved out of contact with at least one of the leads of the switch construction to open the electrical circuit thereof. For example, such a prior known thermally actuatable switch constructions are disclosed and claimed in the U.S. Pat. Nos. to Merrill, 3,180,958, and 3,519,972.

It is a feature of this invention to provide a thermally actuatable switch construction of the above type wherein the bridging member comprises a spring blade that utilizes its own normal bias to move the same to a circuit open position when the temperature sensitive member collapses.

In particular, one embodiment of this invention provides a thermally actuatable switch construction having a housing means provided with a pair of lead means, one of the lead means having a contact means and the other of the lead means having a spring blade means for making contact with the contact means to complete an electrical circuit between the lead means. The spring blade means has a normal bias to move the same out of contact with the contact means to open the circuit. A temperature sensitive member is carried by the housing means and is adapted to collapse when the same is at a predetermined temperature thereof. A biasing means is operatively associated with the temperature sensitive member and the spring blade means to resiliently hold the spring blade means in contact with the contact means as long as the temperature sensitive member is in an uncollapsed condition thereof whereby the biasing means substantially compensates for any shrinkage and/or deterioration of the temperature sensitive member during the uncollapsed life thereof to hold the spring blade means in contact with the contact means as long as the temperature sensitive member has not reached the predetermined collapsing temperature thereof.

Accordingly, it is an object of this invention to provide an improved thermally actuatable switch construction having one or more of the novel features set forth above or hereinafter shown or described.

Another object of this invention is to provide an improved method of making such a thermally actuatable switch construction or the like.

Other objects, uses and advantages of this invention are apparent from a reading of this description, which proceeds with reference to the accompanying drawings forming a part thereof and wherein.

Figure 1:
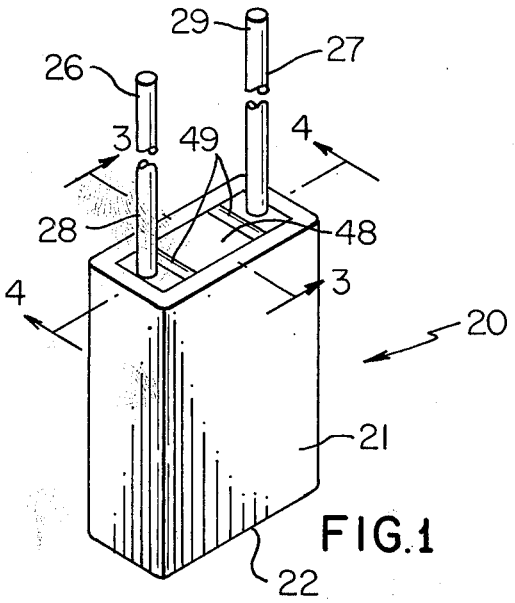
FIG. 1 is a perspective view illustrating one embodiment of the improved thermally actuatable switch construction of this invention.
Figure 2:
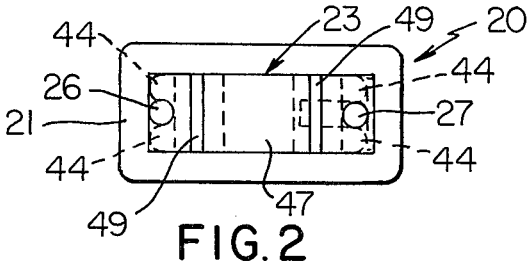
FIG. 2 is a top view of the switch construction of FIG. 1.

While the various features of this invention are hereinafter described and illustrated as being particularly adapted to provide a thermally actuatable switch construction of a particular configuration, it is to be understood that the various features of this invention can be utilized singly or in any combination thereof to provide a thermally actuatable switch construction having other configurations as desired.

Therefore, this invention is not to be limited to only the embodiments illustrated in the drawings, because the drawings are merely utilized to illustrate one of a wide variety of structural configurations.

Referring now to FIGS. 1–5, one embodiment of the improved thermally actuatable switch construction of this invention is generally indicated by the reference numeral 20 and comprises a cup-shaped housing member 21 that is substantially rectangular in any transverse cross-section thereof to define a closed end wall means 22 and an opposed open end wall means 23 subsequently closed by an end plug 24 of this invention in a manner hereinafter described whereby the housing means 21 defines a chamber 25 therein.

The thermally actuatable switch construction 20 includes a pair of lead means 26 and 27 respectively having portions 28 and 29 thereof projecting out of the housing means 21 while respectively having other portions 30 and 31 thereof disposed in the housing means 21 and being exposed to the chamber 25 thereof, the portion 30 of the lead means 26 being suitably flattened and covered with suitable contact material 32 to provide a fixed contact means 33 within the chamber 25 of the housing means 21.

Figure 4:
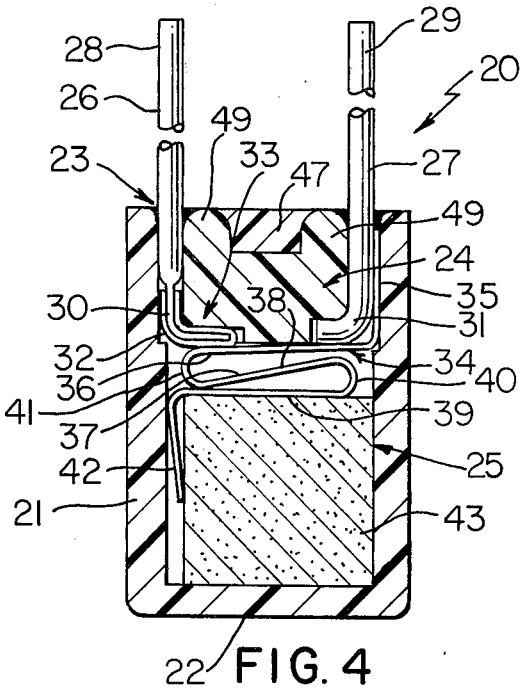
FIG. 4 is a cross-sectional view taken on line 4—4 of FIG. 1.

A spring blade means 34 is disposed in the chamber 25 and has a first part 35 held between the portion 31 of the lead means 27 and the housing means 21 so that the same is in electrical contact with the portion 31 and is held in substantially cantilevered fashion at the portion 35 thereof so that a free end 36 of the spring blade 34 is adapted to be disposed in contact with the fixed contact 33 as illustrated in FIG. 4 in a manner hereinafter described to complete an electrical circuit between the leads 26 and 27. However, the natural bias of the spring blade 34 is to move the free end 36 thereof out of contact with the fixed contact 33 in the manner illustrated in FIG. 5 in a manner hereinafter described to open the electrical circuit between the leads 26 and 27 for a purpose hereinafter described.

A biasing means or member 37 is formed by a resilient member being reversely bent to define a pair of legs 38 and 39 interconnected by a substantially C-shaped portion 40, the leg 38 being integrally interconnected to the free end 36 of the spring blade 34 by a reversely bent C-shaped portion 41 thereof and the other leg 39 having a turned-over end 42 disposed between the housing 21 and a substantially rectangular temperature sensitive member 43 formed of the material set forth in the aforementioned U.S. Patents to Merrill or other suitable material which will collapse from the solid configuration illustrated in FIG. 4 when the same reaches a predetermined temperature.

In this manner, it can be seen that the biasing means 37 is operatively associated with the spring blade means 34 and the temperature sensitive member 43 to be placed under compression therebetween and thereby hold the spring blade 34 into good electrical contact with the fixed contact 33 as the force of the compressed biasing means 37 is greater than the natural resiliency of the spring blade 34 to move to an open position thereof.

Accordingly, should the temperature sensitive member 43 shrink and/or deteriorate under normal storage and use conditions thereof so as to tend to widen the gap between the heat sensitive member 43 and the fixed contact 33, the biasing means 37 takes up such change in the spacing and still tends to maintain the spring blade 34 in electrical contact with the contact 33 through the stored compression thereof whereby an electrical circuit is provided between the leads 26 and 27 as long as the temperature sensitive member 43 is in its uncollapsed condition as illustrated in FIG. 4.

Figure 5:
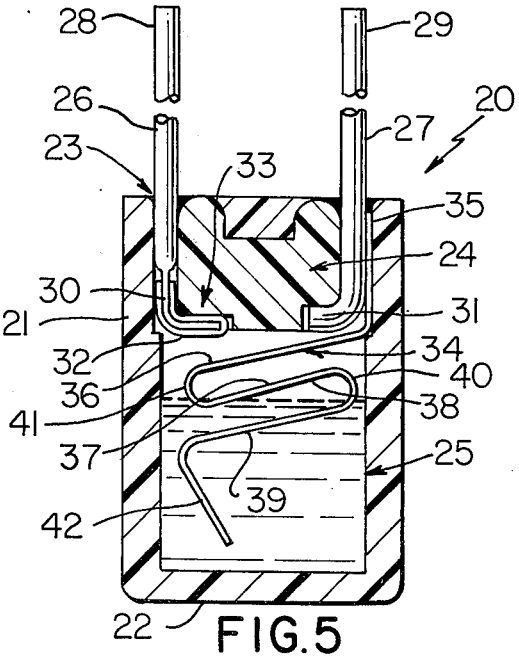
FIG. 5 is a view similar to FIG. 4 and illustrates the switch construction of FIG. 1 after the same has reached the circuit opening temperature thereof.

However, when the temperature of the temperature sensitive member 43 reaches a predetermined temperature by the thermally actuatable switch construction 20 sensing such predetermined temperature, the temperature sensitive member 43 completely collapses so that the biasing means 37 expands to its uncompressed condition and the thus released natural bias of the spring blade 34 will move its movable end 36 out of electrical contact with the fixed contact 33 in the manner illustrated in FIG. 5 and hold the same in the open condition illustrated in FIG. 5 whereby the circuit between the leads 26 and 27 is opened by the thermally actuated switch construction 20.

Figure 3:
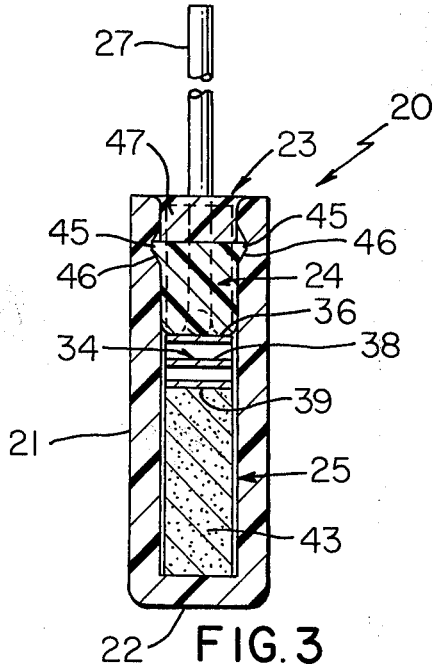
FIG. 3 is a cross-sectional view taken on line 3—3 of FIG. 1.
Figure 6:
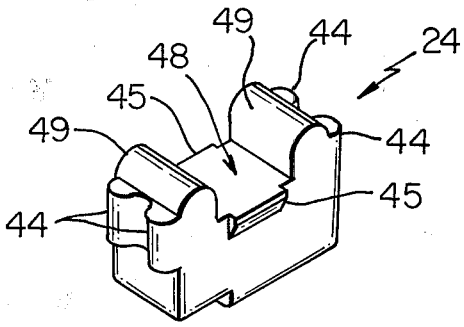
FIG. 6 is a perspective view of an end plug of the switch construction of FIG. 1.

During the assembly of the thermally actuated switch construction 20 of this invention, it can be seen that after the temperature sensitive member 43 and integral biasing means 37 and spring blade means 34 are disposed in place, the leads 26 and 27 can be assembled to the end plug 24 as best illustrated in FIG. 6 between outwardly extending semi-cylindrical portions 44 thereof and the end plug 24 and assembled leads 26 and 27 can be pushed into the open end 23 of the housing 21 until outwardly directed wedging tangs 45 of the end plug 24 snap into cooperating recesses 46 of the housing member 21 as best illustrated in FIG. 3 to hold the end plug 24 in place. Thereafter, suitable epoxy resin 47 or other suitable sealing material can be disposed at the open end 23 of the housing 24 to fill all the spaces between the end plug 24 and the housing member 21 to seal the same in its closed condition, the epoxy material 47 filling the area 48 between two spaced apart substantially semi-cylindrical transverse parts 49 of the end plug 24 to adhere to the inside side walls of the housing means 21 as well as flow into the rounded fillet-like areas around the leads 26 and 27 to substantially hermetically seal the chamber 25 of the housing means 21.

Therefore, it can be seen that the thermally actuatable switch construction 20 of this invention can be made from a relatively few parts in a simple manner to operate in a manner now to be described.

As previously stated, when the temperature sensitive member 43 is in the solid, uncollapsed state illustrated in FIG. 4, the substantially U-shaped biasing means 37 is held compressed between the spring blade 34 and the heat sensitive member 43 so that the compressed state of the biasing means 37 maintains the movable end 36 of the spring blade 34 in good electrical contact with the fixed contact 33. In this manner, the thermally actuable switch construction 20 can be disposed in a suitable electrical circuit whereby the current must pass between the leads 26 and 27 thereof and as long as the spring blade 34 is making contact with the fixed contact 33, the current in the electrical circuit is permitted to flow through the thermally actuatable switch construction 20.

However, when the temperature of the temperature sensitive member 43 reaches a predetermined temperature, such as 300°F, the same collapses by changing from the solid state of FIG. 4 to the liquid or gasseous state of FIG. 5 whereby the biasing means 37 is no longer compressed and the natural bias of the spring blade 34 moves the movable end 36 thereof out of electrical contact with the fixed contact 33 to thereby open the circuit through the switch construction 20 and, thus, open the electrical circuit being protected by the thermally actuatable switch construction 20.

Thus, the switch construction 20 remains in the open condition illustrated in FIG. 5 whereby the switch construction 20 must be replaced by a new switch construction 20 before the electrical circuit being protected thereby can be operated for the reasons set forth in the aforementioned patents to Merrill.

While the biasing means 37 of the switch construction 20 has been illustrated as being formed integrally with the spring blade 34, it is to be understood that the same can be separate therefrom if desired.

Figure 7:
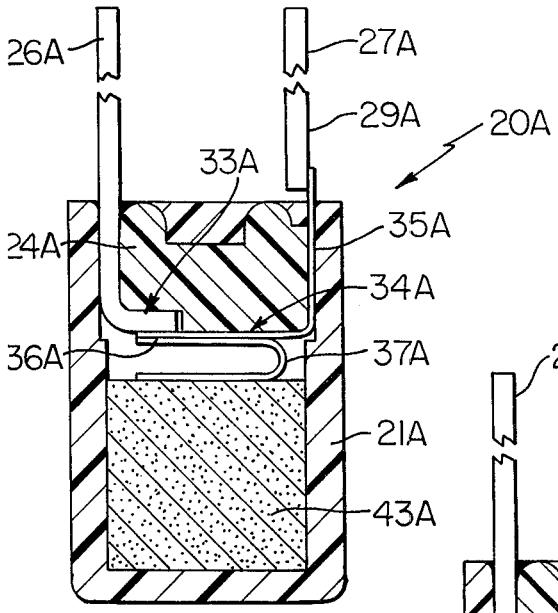
FIG. 7 is a view similar to FIG. 4 and illustrates another thermally actuatable switch construction of this invention.

In particular, another thermally actuatable switch construction of this invention is generally indicated by the reference numeral 20A in FIG. 7 and parts thereof similar to the parts of the switch construction 20 previously described are indicated by like reference numerals followed by the reference letter "A".

As illustrated in FIG. 7, the spring balde 34A has its free end 36A completely separate from a C-shaped biasing leaf spring 37A and has its stationary mounting portion 35A disposed between the end plug 24A and the housing 21A while projecting out of the same to be secured to a terminal lead portion 29A externally of the housing 21A whereby the lead portion 29A and part 35A of the spring blade 34A forms the lead means 27A of the switch construction 20A.

However, the switch construction 20A operates in the same manner as the switch construction 20 previously described so that when the temperature sensitive member 43A collapses in the manner illustrated in FIG.

8, the biasing means 37A is no longer under compression and the same moves away from the spring blade 34A by gravity or by the force of the spring blade 34A so that the natural force of the spring blade 34A moves the movable end 36A thereof away from fixed contact 33A to open the switch construction 20A between the leads 26A and 27A thereof in the manner previously described.

Figure 9:
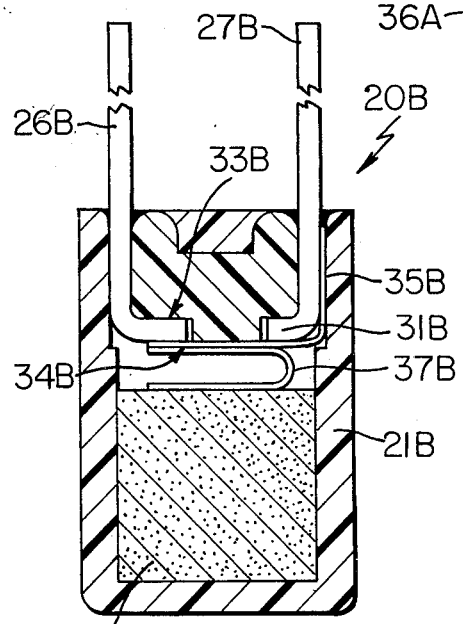
FIG. 9 is a view similar to FIG. 7 and illustrates another thermally actuatable switch construction of this invention.

If it is desired to have the lead portion 29A of the switch construction 20A be secured to the spring blade 34A internally of the housing 21A, the same can be formed in the manner illustrated in FIG. 9 wherein another switch construction of this invention is generally indicated by the reference numeral 20B and parts thereof similar to the switch constructions 20 and 20A are indicated by like reference numerals followed by the reference letter "B".

Figure 10:
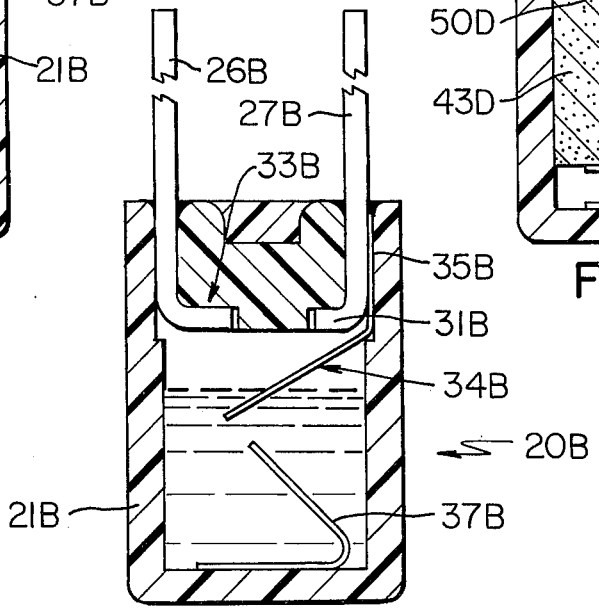
FIG. 10 is a view similar to FIG. 9 and illustrates the thermally actuatable switch construction of FIG. 9 after the same has reached the circuit opening temperature thereof.

As illustrated in FIG. 9, the portion 35B of the spring blade 34B is disposed between the housing 21B and the lead portion 31B of the lead 27B in the same manner as the switch construction 20 while the biasing means 37B comprises a completely separate C-shaped or U-shaped leaf-spring member performing the function of the spring means 37A and 37 previously described. Thus, when the temperature sensitive member 43A collapses in the manner illustrated in FIG. 10, the movable end 36B of the spring blade 34B will move out of contact with the fixed contact 33B and thereby open the electrical circuit between lead means 26B and 27B in the manner previously described.

Figure 11:
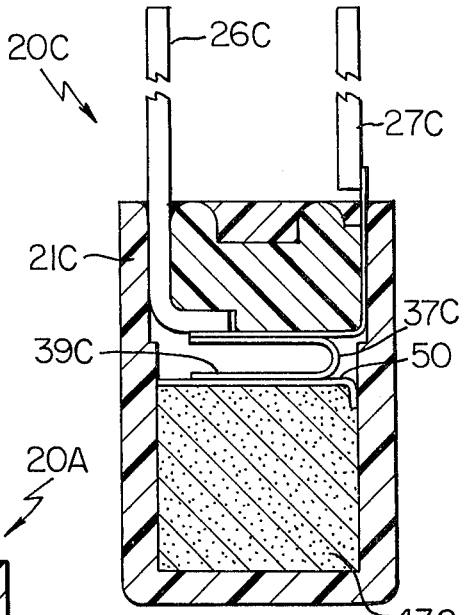
FIG. 11 is a view similar to FIG. 7 and illustrates another thermally actuatable switch construction of this invention.
Figure 8:
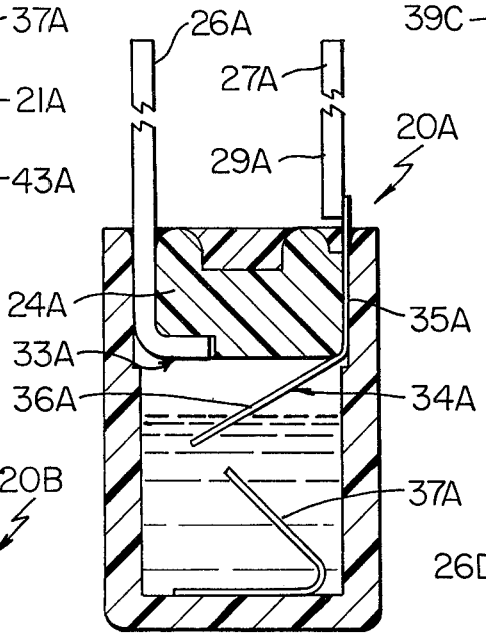
FIG. 8 is a view similar to FIG. 7 and illustrates the switch construction of FIG. 7 after the same has reached the circuit opening temperature thereof.

In order to insure the greatest contact of the lower leg 39, 39A or 39B of the biasing means 37, 37A or 37B with the temperature sensitive member 43, 43A or 43B, a backup plate, such as the backup plate 50 of FIG. 11, can be utilized therebetween.

For example another switch construction 20C of this invention is illustrated in FIG. 11 and is substantially the same as the other switch constructions previously described whereby parts of the switch construction 20C that are similar to like parts of the switch constructions 20, 20A and 20B will be indicated by like reference numerals followed by the reference letter C.

As illustrated in FIG. 11, it can be seen that the backup plate 50 is disposed between the lower leg 39C of the C-shaped biasing means 37C and the temperature sensitive member 43C to thereby present a larger surface area on the temperature sensitive means 43C tending to compress the biasing means 37C than just the area normally contacted by the leg 39C of the biasing means 37C.

Figure 12:
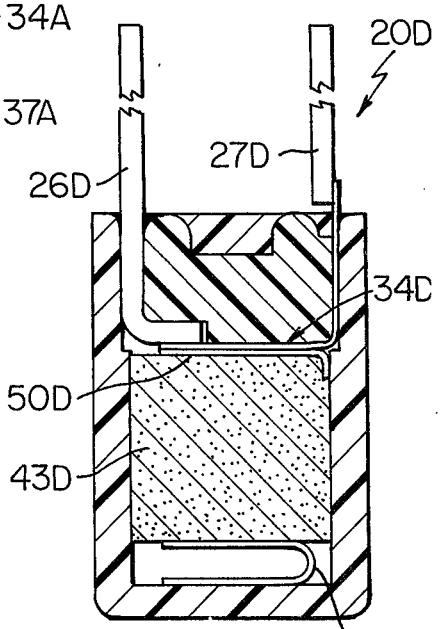
FIG. 12 is a view similar to FIG. 7 and illustrates another embodiment of the thermally actuatable switch construction of this invention.

While the biasing means 37A, 37B and 37C have been illustrated as being respectively disposed intermediate the temperature sensitive members 43A, 43B and 43C and the spring blade 34A, 35B and 35C, it is to be understood that the temperature sensitive member could be disposed intermediate the spring blade and the biasing means as illustrated in FIG. 12.

In particular, it can be seen that another embodiment of the switch construction of this invention is generally indicated by the reference numeral 20D in FIG. 12 and parts thereof similar to the parts of the other switch constructions of this invention are indicated by like reference numerals followed by the reference letter D.

As illustrated in FIG. 12, it can be seen that the temperature sensitive member 43D is disposed intermediate the C-shaped biasing means 37D and spring blade 34D to compress the C-shaped biasing means 37D so that its force will hold the spring blade 34D in its closed condition until the temperature sensitive member 34D reaches its predetermined temperature and thereby collapses to permit the natural bias of the spring blade 34D to open the switch construction 20D. If desired, the backup member 50D can be interposed between the temperature sensitive member 43D and the spring blade 34D.

Therefore, it can be seen that this invention not only provides improved thermally actuatable switch constructions, but also this invention provides improved methods of making such thermally actuatable switch constructions or the like.

While the forms and methods of this invention now preferred have been described and illustrated as required by the Patent Statute, it is to be understood that other forms and method steps can be utilized and still come within the scope of the appended claims.

What is claimed is:

1. A thermally actuatable switch comprising housing means having a pair of lead means, one of said lead means having a contact means, the other of said lead means having a spring blade means for making contact with said contact means to complete an electrical circuit between said lead means, said spring blade means having a normal bias to move the same out of contact with said contact means to open said circuit, a temperature sensitive member carried by said housing means and being adapted to collapse when the same is at a predetermined temperature thereof, and biasing means operatively associated with said temperature sensitive member and said spring blade means to resiliently hold said spring blade means in contact with said contact means as long as said temperature sensitive member is in an uncollapsed condition thereof.

2. A thermally actuatable switch as set forth in claim 1 wherein said biasing means comprises a substantially reversely looped spring member.

3. A thermally actuatable switch as set forth in claim 2 wherein said spring member is integral with said spring blade means.

4. A thermally actuatable switch as set forth in claim 2 wherein said spring member is separate from said spring blade means.

5. A thermally actuatable switch as set forth in claim 1 wherein said biasing means is disposed intermediate said spring blade means and said temperature sensitive member.

6. A thermally actuatable switch as set forth in claim 5 wherein a backup plate means is disposed intermediate said biasing means and said temperature sensitive member.

7. A thermally actuatable switch as set forth in claim 1 wherein said biasing means comprises a substantially U-shaped spring member.

8. A thermally actuatable switch as set forth in claim 1 wherein said housing means is substantially rectangular in transverse cross section thereof and defines a chamber therein that receives said spring blade means, said biasing means and said temperature sensitive member.

9. A thermally actuatable switch as set forth in claim 1 wherein said housing means has a chamber therein that receives said spring blade means and said biasing means and said temperature sensitive member therein, said lead means each having a first portion thereof projecting into said chamber and a second portion thereof projecting out of said housing means for lead attachment purposes.

10. A thermally actuatable switch as set forth in claim 9 wherein said spring blade means is secured to one of said portions of said other lead means.

11. A thermally actuatable switch comprising housing means, first lead means provided with a contact surface and extending into said housing, second lead means extending into said housing for temperature controlled electrical connection with said first lead means, electrically conductive spring blade means in permanent electrical connection with said second lead means and supported for contact with said contact surface but having a normal spring bias urging it away therefrom, and a temperature sensitive member mounted within said housing for urging said spring blade means toward electrical contact with said contact surface when said switch is exposed to temperatures below a predetermined temperature and collapsing to permit movement of said spring blade means away from electrical contact with said contact surface when said switch is exposed to temperatures above said predetermined temperature.

12. A thermally actuatable switch according to claim 11 further comprising biasing means cooperating with said temperature sensitive member to maintain said spring blade means in electrical contact with said contact surface when said switch is exposed to temperatures below said predetermined temperature.

13. A thermally actuatable switch according to claim 12 wherein said biasing means comprises a substantially U-shaped spring member disposed intermediate said spring blade means and said temperature sensitive member.

14. A thermally actuatable switch according to claim 12 wherein said spring blade means is secured to said second of said lead means.

15. A thermally actuatable switch according to claim 14 wherein said housing is substantially rectangular in transverse cross section.

16. A thermally actuatable switch according to claim 15 wherein said housing has an opening at one end for receiving said lead means, said spring blade means, said biasing means and said temperature sensitive member and wherein said switch further comprises an end plug for snap fitting into said opening and a sealing material covering said end plug with said lead means extending therethrough.

17. A thermally actuatable switch according to claim 11 wherein said spring blade means is provided with a reversely looped spring extension for biasing said spring blade means into electrical contact with said contact surface when said switch is exposed to temperatures below said predetermined temperature.

* * * * *